US011421520B2

(12) United States Patent
Zaripov

(10) Patent No.: US 11,421,520 B2
(45) Date of Patent: Aug. 23, 2022

(54) DRILLING PARAMETER OPTIMIZATION FOR AUTOMATED WELL PLANNING, DRILLING AND GUIDANCE SYSTEMS

(71) Applicant: AI DRILLER, INC., Katy, TX (US)

(72) Inventor: Marat Zaripov, Katy, TX (US)

(73) Assignee: AI DRILLER, INC., Katy, TX (US)

( * ) Notice: Subject to any disclaimer, the term of this patent is extended or adjusted under 35 U.S.C. 154(b) by 0 days.

(21) Appl. No.: 15/733,605

(22) PCT Filed: Mar. 13, 2019

(86) PCT No.: PCT/US2019/022068
§ 371 (c)(1),
(2) Date: Sep. 11, 2020

(87) PCT Pub. No.: WO2019/178240
PCT Pub. Date: Sep. 19, 2019

(65) Prior Publication Data

US 2021/0025269 A1 Jan. 28, 2021

Related U.S. Application Data

(60) Provisional application No. 62/642,041, filed on Mar. 13, 2018.

(51) Int. Cl.
*E21B 44/02* (2006.01)
*E21B 47/00* (2012.01)
(Continued)

(52) U.S. Cl.
CPC ..... *E21B 44/02* (2013.01); *E21B 7/04* (2013.01); *E21B 47/00* (2013.01); *E21B 49/003* (2013.01)

(58) Field of Classification Search
CPC ..... E21B 44/02; E21B 45/00; E21B 47/00; E21B 47/12; E21B 49/003; E21B 7/04; E21B 44/00
See application file for complete search history.

(56) References Cited

U.S. PATENT DOCUMENTS 5,454,442 A 10/1995 Labuhn
6,050,348 A 4/2000 Richardson
(Continued)

FOREIGN PATENT DOCUMENTS

WO 2014100613 A1 6/2014
WO 2014147116 A1 9/2014
WO 2017180157 A1 10/2017

OTHER PUBLICATIONS

International Search Report and Written Opinion dated Mar. 13, 2019 for corresponding PCT/US2019/022068.
(Continued)

*Primary Examiner* — Daniel P Stephenson
(74) *Attorney, Agent, or Firm* — Ramey LLP; Daniel J. Krueger

(57) ABSTRACT

An automation system for a drilling rig includes a processor and a computer memory in communication with the processor and storing computer executable instructions, that when implemented by the processor cause the processor to perform functions that include receiving as a function of time at least one of a) at least one surface operating parameter and b) at least one downhole operating parameter. The processor further may at least one of filter and smooth the at least one surface operating parameter and the at least one downhole operating parameter to generate processed data. The processor may generate a measure of drilling energy from the processed data and determine a minimum of the measure of the drilling energy, and calculate a target value of the at least one of the at least one surface operating parameter and the at least one downhole operating parameter.

15 Claims, 3 Drawing Sheets

(51) Int. Cl.
*E21B 49/00* (2006.01)
*E21B 7/04* (2006.01)

(56) References Cited

U.S. PATENT DOCUMENTS

| | | | | |
|---|---|---|---|---|
| 6,918,453 | B2 | 7/2005 | Haci | |
| 7,896,105 | B2 | 3/2011 | Dupriest | |
| 7,938,197 | B2 | 5/2011 | Boone | |
| 8,210,283 | B1 * | 7/2012 | Benson | E21B 47/06 175/61 |
| 8,528,663 | B2 | 9/2013 | Boone | |
| 8,672,055 | B2 | 3/2014 | Gilbert | |
| 9,180,890 | B2 | 11/2015 | Lu | |
| 9,285,794 | B2 | 3/2016 | Wang | |
| 9,309,760 | B2 | 4/2016 | Haci | |
| 9,347,308 | B2 | 5/2016 | Benson | |
| 9,359,881 | B2 * | 6/2016 | DiSantis | E21B 44/00 |
| 9,404,356 | B2 | 8/2016 | Benson | |
| 9,428,961 | B2 | 8/2016 | Benson | |
| 9,429,676 | B2 | 8/2016 | Benson | |
| 9,494,030 | B2 | 11/2016 | Benson | |
| 10,428,638 | B2 * | 10/2019 | Miller | E21B 44/04 |
| 10,837,277 | B2 * | 11/2020 | Logan | E21B 49/00 |
| 10,922,455 | B2 * | 2/2021 | Samuel | G06F 30/23 |
| 2002/0104685 | A1 | 8/2002 | Pinckard | |
| 2003/0220742 | A1 | 11/2003 | Niedermayr et al. | |
| 2009/0132458 | A1 | 5/2009 | Edwards | |
| 2010/0228420 | A1 | 9/2010 | Lee | |
| 2011/0186353 | A1 * | 8/2011 | Turner | G01H 1/003 175/40 |
| 2012/0118637 | A1 | 5/2012 | Wang et al. | |
| 2012/0123756 | A1 | 5/2012 | Wang | |
| 2013/0105221 | A1 | 5/2013 | Wassell | |
| 2014/0151121 | A1 | 6/2014 | Boone | |
| 2014/0277752 | A1 | 9/2014 | Chang et al. | |
| 2014/0326449 | A1 * | 11/2014 | Samuel | E21B 41/0092 166/250.01 |
| 2015/0252664 | A1 | 9/2015 | Astrid et al. | |
| 2016/0054729 | A1 * | 2/2016 | Payette | E21B 7/00 700/275 |
| 2016/0288789 | A1 | 10/2016 | Durgin | |
| 2019/0048706 | A1 * | 2/2019 | Benson | E21B 44/00 |
| 2019/0257197 | A1 * | 8/2019 | Palmer | E21B 47/13 |
| 2019/0277130 | A1 * | 9/2019 | Zarate Losoya | E21B 7/04 |
| 2019/0330968 | A1 * | 10/2019 | Boone | E21B 7/04 |
| 2020/0149384 | A1 * | 5/2020 | Benson | E21B 47/002 |
| 2020/0257420 | A1 * | 8/2020 | Ramchune | G06F 3/0484 |
| 2020/0277823 | A1 * | 9/2020 | Stevens | E21B 47/12 |
| 2020/0300064 | A1 * | 9/2020 | Gee | E21B 41/0092 |
| 2020/0308952 | A1 * | 10/2020 | Pournazari | G06N 3/006 |
| 2021/0025269 | A1 * | 1/2021 | Zaripov | E21B 7/04 |
| 2021/0108500 | A1 * | 4/2021 | Venugopal | E21B 41/00 |
| 2021/0270097 | A1 * | 9/2021 | Ng | E21B 21/08 |
| 2021/0293128 | A1 * | 9/2021 | Benson | E21B 47/047 |

OTHER PUBLICATIONS

Extended European Search Report dated Nov. 15, 2021 for related European Patent Application No. 19767119.1.

Basbar, Ashraf E., Al Kharusi, Ahmed , and Abdulbaqi Al Kindi. "Reducing NPT of Rigs Operation through Competency Improvement: A Lean Manufacturing Approach." SPE-180066-MS Paper presented at the SPE Bergen One Day Seminar, Grieghallen, Bergen, Norway, Apr. 2016. doi: https://doi.org/10.2118/180066-MS.

* cited by examiner

DRILLING PARAMETER OPTIMIZATION FOR AUTOMATED WELL PLANNING, DRILLING AND GUIDANCE SYSTEMS

CROSS-REFERENCE TO RELATED APPLICATIONS

This application is a 371 National Phase Application of PCT/US2019/022068 filed Mar. 13, 2019 and titled "Drilling Parameter Optimization for Automated Well Planning, Drilling, and Guidance System", which in turn claims the benefit of and priority to U.S. Provisional Patent Application No. 62/642,041 titled "Drilling Parameter Optimization for Automated Well Planning, Drilling, and Guidance System" and filed Mar. 13, 2018, the disclosures of which are incorporated in their entirety by this reference for all purposes.

BACKGROUND

Automation of processes for drilling oil and gas wells is a subject that has been widely discussed in the last several decades. Multiple methods and theories have been proposed, numerous scientific articles published, several successful and unsuccessful tests have been made, but drilling crews continue to experience a distressing amount of Non-Productive Time (NPT) during drilling. Excessive NPT hinders oil and gas operators economically because labor costs and capital expenses continue to accrue even when no drilling progress occurs. A study conducted by Basbar et al. (SPE-180066-MS) shows that total NPT typically accounts for 10-15% of total drilling costs and in some cases can rise as high as 30%. The same study also identifies main reasons for NPT for a sampled set of drilling and workover rigs as crew competency related (42%), mechanical equipment failure (27.6%), and operational equipment failure (12.7%). Thus, it may be expected that automating the processes related to decision making during real-time drilling may substantially reduce NPT that are a function of crew competency and may reduce the operational equipment failure rates, which together contribute to over half of the total NPT accumulated during drilling.

Typically, the decision-making process at a well site may involve several people, depending on the specific decision being made. The oil/gas field operator employs reservoir engineers ("reservoir team") and geologists ("the geology team") to define the wellbore objectives. Each drilling rig has an assigned Drilling Engineer (DE) who prepares a Drilling Well Program (DWP) including a wellbore trajectory made to fit and accomplish drilling objectives set by the reservoir team and the geology team. Depending on the complexity of the wellbore objectives, the DWP can be a lengthy document. The operator typically also has a Wellsite Manager (WM or "company man") on-site with the rig, who may work with a Directional Driller (DD) (typically from a 3rd-party Directional Drilling Services provider), a measurement-while-drilling (MWD) engineer, a Rig Supervisor or Manager (also known as a Tool pusher (TP)), and a drilling rig operator (Driller), to assemble the needed tools, materials, and personnel, and to formulate the course of action for implementing the DWP.

The Driller then commences drilling operations, setting the operating parameters of the drilling rig to implement the chosen course of action under the instruction of the DD. The Driller is responsible for controlling the rig, while the DD is responsible for calculating real-time wellbore position and look-ahead projections (e.g., a forecast of where the drill bit and wellbore will be based on historical and real-time wellbore position data) based on trajectory measurement data. The DD is also responsible for decisions on whether to continue drilling or applying corrections to the wellbore positioning based on constantly-updated calculations and look-ahead projections. In most cases, the DD is also responsible for drilling parameter selection and real-time drilling optimization based on seen trends and knowledge of local drilling history, (i.e., selecting desired or target values for the operating parameter values).

Directional drilling involves steering the trajectory of an oil or gas wellbore as it is drilled. One of the most common methods of directional drilling involves deviating the wellbore with steerable or "bent" motor bottom hole assembly (BHA), or in growing instances, a rotary steerable system (typically push the bit or point the bit systems). In those BHAs that involve a steerable motor assembly, the method involves a bottom hole assembly with a downhole drilling motor having a slight bend (typically at its adjustable bent housing) that results in a drill bit tilt or a misalignment in the central axis of the drill bit away from the central axis of the drill string. This type of BHA will be referred to herein as a steerable motor BHA.

Controlled steering of a wellbore using a steerable motor BHA is accomplished by orienting the bend of the steerable motor assembly in the direction that the wellbore is to be deviated and drilling without continuous rotation of the drill string above the steerable motor in a process typically referred to as sliding or slide drilling. As drilling fluid is pumped through the drilling motor, the bit box of the motor, and thus the drill bit, will continue to rotate. This will cause the bit to drill the wellbore in the direction of the bend in the motor due to the side forces introduced as a result of the deviated axis of the drill bit. The slide drilling interval can be likened to a vector having both a direction, defined by orientation (tool face angle) of the bend in the motor, and a magnitude defined by the distance of the wellbore that was drilled.

The wellbore deviation (azimuth and bend angle) resulting from the slide drilling interval will depend on the aggregate direction of the motor bend orientation (tool face angle) throughout the interval, the distance of the interval over which slide drilling occurs, the angle of the bend in the steerable motor, BHA characteristics, and several other environmental, operational and geometric factors. When a slide drilling interval is projected to have achieved the desired deviation of the wellbore and it is desired to drill the wellbore "straight" or in a continuous trajectory, the drill string can be rotated at surface (rotary drilling), thus rotating the steerable motor downhole. If the steerable motor is rotated continuously downhole while drilling the wellbore, the side forces are evenly distributed (i.e., not acting in a preferential direction) and thus the wellbore will tend to follow a continuous trajectory in a direction along the central axis of the BHA above the motor bend. As a result of continuous slide drilling or alternating intervals of slide and rotary drilling, a wellbore can be deviated to follow a given profile and trajectory with a high level of accuracy.

To achieve any degree of accuracy in directional drilling, several systems are typically employed in addition to the steerable motor BHA described in the above section. In order to follow a defined trajectory, the 3-dimensional spatial position and azimuthal orientation of the bottom hole assembly are measured during the drilling process. While the total measured depth of the borehole is usually determined at the surface by measuring the length of the drill string and its components deployed below a predetermined fixed reference (typically the rig or drilling floor), the BHA location and orientation information are usually measured downhole and communicated to surface. A Measurement While Drilling (MWD) system is typically used to collect measurements of wellbore inclination and azimuth, as well as the tool face angle, which is the rotational orientation of the BHA within the borehole, usually measured relative to the top side of the hole (gravity tool face, or GTF) or the north side of the hole (magnetic tool face, or MTF) depending on the inclination of the wellbore.

While the steerable motor BHA and MWD system measure and direct the orientation of the wellbore, the drilling rig is responsible for providing the energy and actuation required to physically drill the wellbore. Modern rotary drilling rigs can vary by the contractor, but the following systems are common to all: hoisting system, a fluid pumping system, and a rotary drive system. The hoisting system consists of a mast and a drawworks and is responsible for raising and lowering the drill string and controlling the weight applied to the drill bit at the bottom of the hole. The fluid system consists of pumps and a pipe system for circulating drilling fluid, often referred to as "mud," through the interior of the drill string to exit via ports in the bit and return to surface through the annulus of the wellbore. Drilling fluid is important to the drilling process for several reasons including providing hydrostatic pressure downhole to prevent uncontrolled escape of reservoir fluids while drilling, removing cuttings from the borehole, and providing hydraulic power to downhole tools such as the drilling motor and MWD tools. The fluid can also act as a medium to allow the downhole tools to communicate with surface equipment. The rotary drive system includes either a top drive or kelly and rotary table to provide rotational energy to the drill string at surface. This energy is transmitted through the drill string to the drill bit, destroying the rock and thereby drilling the wellbore. When a drilling motor is utilized in the BHA, the rotary energy supplied by the topdrive is supplemented by the rotational energy generated by the motor as a result of the fluid being pumped through it.

The need to optimize drilling rig performance arises from several factors. These include economic implications of running multiple bottom hole assemblies (BHA) while drilling, as well as increasing rig costs by drilling at less than optimal rates of penetration, and possibly increasing the interaction of men and equipment that may increasing potential risks to health and safety. Completing each drilling operation in a relatively short, consistent time helps oil and gas operators to more effectively meet their budgetary needs. Further, drilling optimization can lead to more stable wellbores, less tortuous well path trajectories, and better production performance.

Numerous theoretical and empirical methods have been proposed and utilized to decrease drilling time, but faster drilling can also mean faster wear, shortening the bit life and requiring additional time tripping the bit in and out of the hole. In recent years, special approaches have been taken to maximize the life of drilling bottom hole assembly components. These approaches include methods of selecting bits, improving bit material and design, evolution of drilling drive systems, introduction of rotary steerable systems, stabilizer placement and sizing selection, shock and vibration reductions, stick-and-slip minimization, drilling component metallurgy, etc. However, one of the most effective methods used today involves the determination and application of optimized drilling parameters based on drilling data analysis.

At least some such analysis involves the use of Mechanical Specific Energy (MSE) values to determine an optimal set of drilling parameters that will extend the life of BHA and at the same time achieve the most effective ROP. When used as a measure of drilling efficiency, MSE is the energy required to remove a unit volume of rock from the formation at the bottom of the hole. MSE can be expressed mathematically in terms of weight on bit (WOB), Torque, Rate of Penetration (ROP), and rotations per minute (RPM). Optimizing these parameters so as to minimize the MSE has been shown to maximize the ROP. The interdependence of these parameters means that the optimum values of Torque, ROP, and RPM can be readily determined once the WOB versus MSE relationship is identified and the optimum WOB value determined therefrom.

Conventionally, the MSE vs. WOB relationship is measured through step-testing, which involves setting the WOB (or "SWOB", which is the weight on bit as measured at the surface) at a first value for a first drilling interval, at a second value for a second drilling interval, at a third value from a third interval, and so on. An average MSE value is determined for each interval and plotted with interpolation from previous values to determine the trend. Typically, the WOB value continues to be incremented in steps until the relationship between the MSE and WOB departs from linearity. The point at which the departure from linearity occurs is called a "founder" point. At this point, the drilling system is near a maximum ROP point (minimum MSE point), beyond which further increases in SWOB will cause the MSE to increase and drilling performance to deteriorate. The test concludes and normally drilling resumes at the last SWOB preceding the departure from linearity.

However, MSE is very susceptible to multiple environmental parameters, such as changes in geology, BHA dynamics, bit deterioration, trajectory, etc., making it challenging to determine the optimal drilling parameter values with any degree of certainty. The conventional step test approach tries to address this issue by averaging measurements over extended drilling intervals. Thus, it is not unusual for the step-test to require more than 50 feet before an optimal SWOB point has been found. Depending on the geological formations being drilled, the test can take anywhere from 15 minutes to several hours to complete. Taking into account the lower SWOB values employed during the early portions of the test, the test may take even longer, creating an unacceptable time loss for the drilling operations. As such, step-tests are not conducted regularly throughout the drilling process and may in some cases only be employed at the beginning of a drilling run or immediately after a shift change. The step-test process is also complicated by the non-homogeneous nature of the rock that is being drilled. For example, in the highly-laminated vertical sections of the wells in Permian Basin, it is not uncommon to see geological changes every 3 to 5 feet (0.9 to 1.5 meters) of drilling. A step-test may be unable to provide consistent MSE measurements in this environment, as the rock properties fluctuate substantially from one formation to another and can lead to false-positive results. To take such considerations into account, most step-tests are done manually, creating a big opportunity for human related mistakes, ranging from false data acquisition and calculation issues to misinterpretation of founder points.

As can be seen, tremendous responsibility rests on the shoulders of the DD and the driller. Successful completion of the drilling operation depends on the ability of the DD and the driller to perform timely observations, calculations, and accurate predictions of variation or changes in the trajectory of the wellbore. Achieving geological targets and maximizing directional control may also be decisive in the future performance of the well during the production phase.

Thus, it is very important that the personnel on the drill rig is highly trained and has natural ability at these tasks. Industry challenges with staffing and economics often makes it challenging to consistently provide crews with the above-mentioned skills and abilities, which may lead to an undesirable increase of otherwise avoidable or minimizable NPT.

Therefore, there is a need for a cost effective, efficient, and improved system for planning and drilling wells.

BRIEF SUMMARY

An automation system for a drilling rig comprises a processor configured to implement computer executable instructions. The process is couplable to at least one of a) a rig control system, b) an electronic data recorder, and c) at least one rig sensor and is configured to receive at least one of a) at least one surface operating parameter generated by the at least one rig sensor and b) at least one downhole operating parameter generated by at least one tool disposed in a wellbore. The automation system may further include at least one input device in communication with the processor and configured to receive a user input and at least one output device in communication with the processor. The automation system optionally includes a computer memory in communication with the processor and storing computer executable instructions, that when implemented by the processor cause the processor to perform functions comprising: receiving as a function of time at least one of a) the at least one surface operating parameter b) the at least one downhole operating parameter; at least one of filtering and smoothing the at least one of a) the at least one surface operating parameter and b) the at least one downhole operating parameter to generate processed data; and, generating a measure of drilling energy from the processed data; identifying at least one learning interval; calculating a distribution of the measure of drilling energy as a function of the processed data; determining a minimum of the measure of the drilling energy; and, calculating a target value of the at least one of a) the at least one surface operating parameter and b) the at least one downhole operating parameter.

The functions that the automation system may perform may further include one or more of displaying the target value on the output device; transmitting the target value to a control system communicatively coupled to the automation system; transmitting at least one of the target value, the measure of drilling energy, the at least one surface operating parameter, and the at least one downhole operating parameter to another Internet connected device.

Optionally, the at least one tool disposed within the wellbore may be one of a measurement while drilling tool and a logging while drilling tool.

The at least one learning interval of the automation system may be a function of at least one of a) the processed data, b) a transition of a drill string disposed within the well bore from off a bottom of the well bore to on the bottom of the well bore, and c) a change of at least one of the at least one surface operating parameter and the at least one downhole operating parameter greater than or equal to 5 percent, 2 percent, 1 percent or smaller of the at least one surface operating parameter and the at least one downhole operating parameter at a preceding time.

The step of calculating the distribution of the measure of drilling energy as a function of the processed data may further include plotting the measure of drilling energy against the processed data.

The automation system may perform functions that also include any one or more of the following functions in any combination: calculating a first toolface of a drill bit; comparing the first toolface to a target toolface; calculating a second toolface of the drill bit after at least one of a) rotating a drill string disposed in the well bore b) changing a differential pressure and c) changing at least one of a surface weight on bit and a downhole weight on bit; and, deriving a relationship between the processed data and the second toolface; calculating a toolface adjustment factor as a function of the relationship between the processed data and the second toolface, wherein the toolface adjustment factor is a recommended adjustment to be applied to the drill string so as to maintain a third toolface of the drill bit at the targeted toolface; applying the toolface adjustment factor to the drill string; calculating the third toolface after the toolface adjustment factor has been applied to the drill string; comparing the third toolface to the targeted toolface; one of a) recalculating the toolface adjustment factor if the third toolface is not substantially equal to the targeted toolface and b) holding the third toolface and slide drilling if the third toolface is substantially equal to the targeted toolface; changing the surface weight on bit and the differential pressure; determining whether a relationship between the change in the surface weight on bit and the change between the differential pressure change is monotonic; and if the relationship between the change in the surface weight on bit and the change between the differential pressure change is not monotonic applying a rotary oscillation to the drill string; and, adjusting at least one of a frequency and an amplitude of the rotary oscillation until the relationship between the change in the surface weight on bit and the change between the differential pressure change until the relationship becomes monotonic.

The toolface adjustment factor may include at least one of a number of drill string rotations to be applied to the drill string, a targeted differential pressure, a targeted surface weight on bit, and a targeted downhole weight on bit.

A method of developing a drilling plan for a well bore may include obtaining at least one operating parameter as function of at least one of time and of depth from an existing offset well and using the processor of the automation system described above to execute the functions described above with the at least one operating parameter as a substitute for at least one of a) the at least one surface operating parameter and b) the at least one downhole operating parameter. The method of developing a drilling plan may further include calculating at least one of a minimum target value and a maximum target value for of the at least one the at least one operating parameter from the existing offset well for a given formation and optionally generating a recommended trajectory for a new well bore.

A drilling rig that may include one or more of the components of the automation system configured to perform one or more of the aforementioned functions coupled to at least one of a) the rig control system, b) the electronic data recorder, and c) the at least one rig sensor.

A method of drilling well may include assembling a drill string and a bottom hole assembly, disposing the drill string and the bottom hole assembly in a well bore; and, calculating with one or more of the components of the automation system configured to perform one or more of the aforementioned functions the target value of the at least one of a) the at least one surface operating parameter and b) the at least one downhole operating parameter.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which.

The drawings are not necessarily to scale.

DETAILED DESCRIPTION

Figure 1:
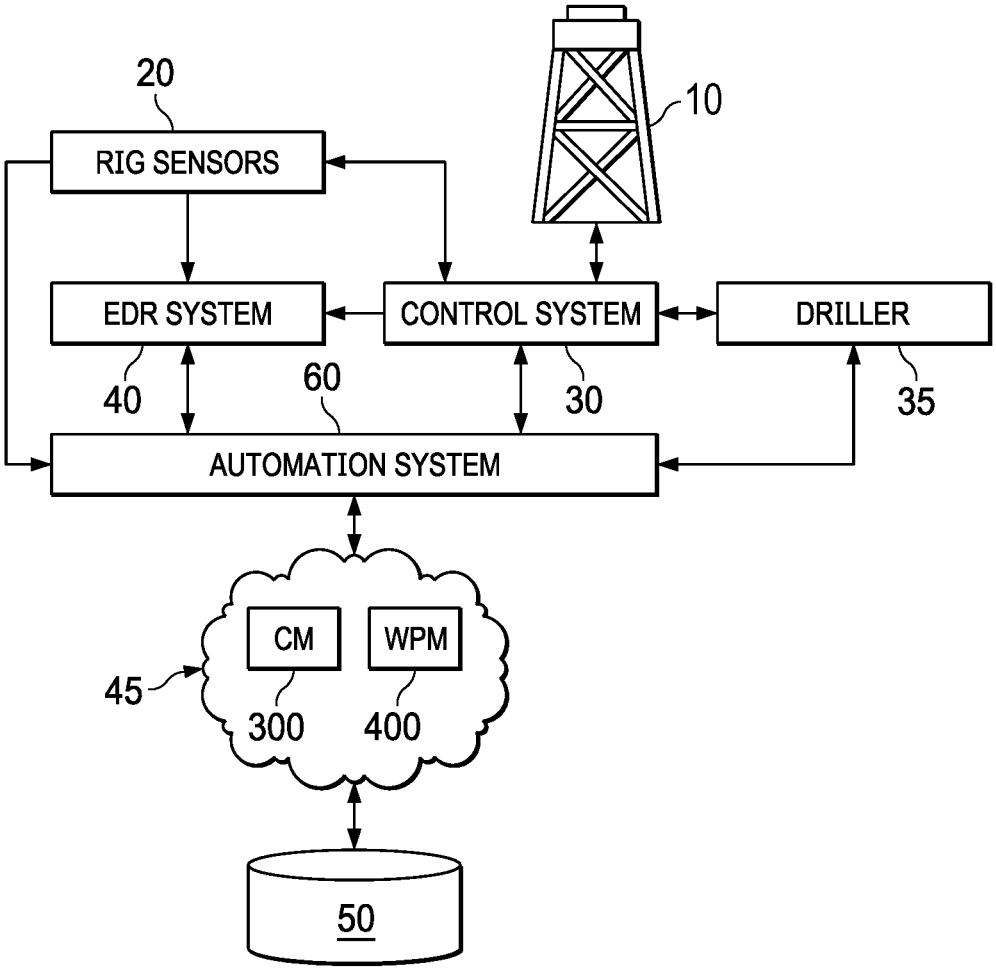
FIG. 1 illustrates an embodiment of a drilling rig and an embodiment of an automation system.
Figure 2:
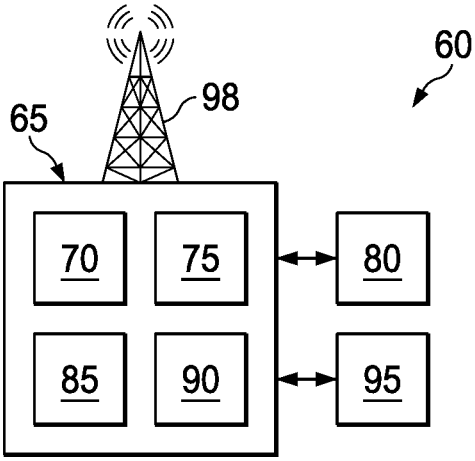
FIG. 2 details optional elements of the automation system.

As shown in FIG. 1, a drilling rig 10 may be equipped with an array of electronic sensors 20 that measure one or more parameters of one or more of the various systems on the drilling rig 10, including a variety of operating parameter values and movements of the hoist, from which it is possible to determine the hole depth and the position of a drill bit in the hole. A control system 30 receives the various signals form the rig sensors 20 representative of the operating parameter values measured by each sensor measurements in real time so as to display the received data to the driller and/or the DD 35 and to accept commands for actuating and maintaining operating parameter values of the pumps, hoisting system, and rotary drive system. The operating parameters may include WOB, Torque, RPM, and ROP. The control system 20 may include feedback control loops to maintain one or more of the operating parameter values at or near the values set by the driller, subject to safety limits and selectable input signals from other systems.

The rig sensor measurements and driller commands are collected and archived by an Electronic Drilling Recorder (EDR) system 40. With the availability of multithreaded computer processors and high-speed internet access, modern EDR systems 40 may have computational resources to spare. Thus, the EDR system 40 may also perform real-time filtering and processing of the measurement data, enabling it to serve as a primary source of real time drilling information for real time analysis and decision making.

The control system 30 may further convey to the driller analysis results and recommendations from the EDR system 40 or off-site personnel.

To address the issues identified in the background, the drilling rig of FIG. 1 is equipped with an automation system 60 to automate some of the processes that the DD and the driller conduct during a drilling operation. FIG. 1 shows the automation system 60 as a separate unit coupled to the control system 30, but at least some contemplated system embodiments optionally may incorporate the functionality of the automation system 60 into the EDR system 40 or the control system 30 itself (not illustrated, although one of skill in the art would appreciate that such embodiments would illustrate the automation system 60 box as a subsystem or box within the representative boxes for the EDR system 40 and/or the control system 30).

Employing the principles disclosed herein below, the automation system 60 determines optimized value(s) for at least one operating parameter and communicates the optimized value to the EDR system 40 and/or the control system 30, which may convey the optimized values to the driller as recommendations and/or adjust the operating parameters of the drilling rig 10 directly via executable command to the control system 30. The automation system 60 can operate to provide automatic trajectory control, precise look-ahead projections based on the observed relationships and offset analysis, BHA dynamics calculations, prediction of when to apply corrections to the wellbore, and drilling performance optimization.

The automation system 60, whether implemented as an advisory system for the driller and/or the DD or an automated control system, may include at least one of the following components or a plurality of the following components in any combination, which are discussed in turn below: Rotary control module (aka Rotation module) 100; Sliding control module (aka Slide module) 200; Correlation module (aka Correlation engine) 300; and Well position module (aka Automated guidance system) 400.

The various modules may be implemented as electronic hardware (e.g., application specific integrated circuit, or ASICs), or firmware (e.g., programmable logic array, or PLAs), but an embodiment of the automation system 60 may include software executed by an operating system of a general purpose computer 65 including at least one or more of the following components, whether individually or in any combination: at least one central processing unit 70, a system memory 75, an output device 80 (such as a video display interface), and an input-output bus 85 coupled to nonvolatile information storage 90 (e.g., hard disk drive or read only memory, including electronic and electronically erasable programmable read only memory), at least one user input devices (e.g., keyboard, mouse, touch screen/tablet/cell phone, each of which may also double as an output device) 95, and a network interface 98 (such as an ethernet card, wi-fi card, satellite, other wireless, infrared, near-field connector, and so forth) for communicating with other computers.

The automation system 60 may receive and interpret drilling data as inputs from the rig control system 30, run the calculations described in the functions and methods below, and send at least one executable command to the rig control system 60. The automation system 60 may further display the calculation results to a user via the report or output device 80 and upload data to a server system 50 at an on-site or off-site location of the Internet or cloud-based storage 45.

Rotary Control Module

Figure 3:
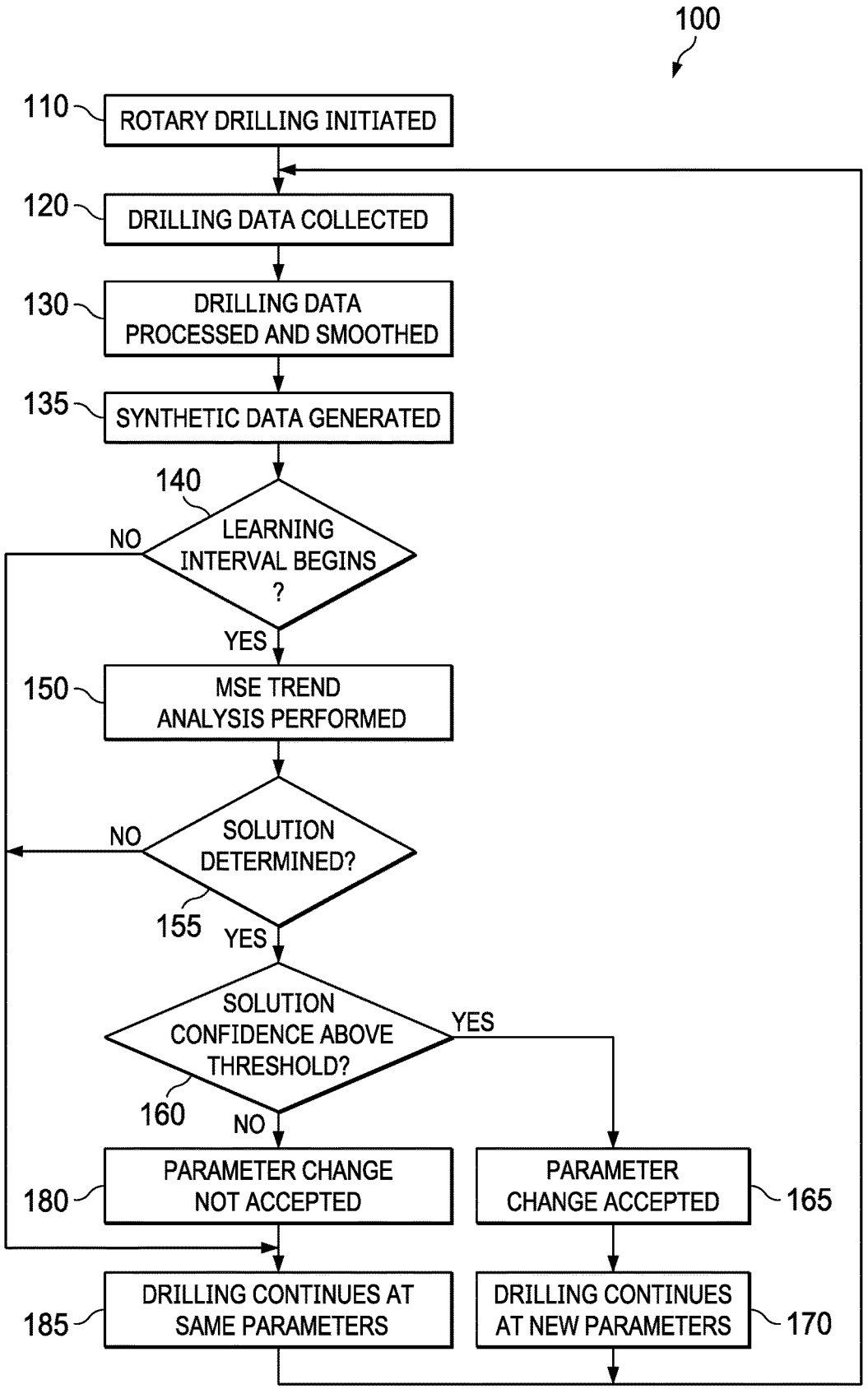
FIG. 3 illustrates a rotary control module of the automation system.

The rotary control module 100 illustrated in FIG. 3 as implemented by the automation system 60 is a method for automated optimization of rotary drilling. The rotary control module 100 collects surface sensor data from the rig sensors 20 either directly and/or indirectly via at least one of the EDR system 40 and the control system 30, filters and processes the time series data, evaluates a drilling energy function, and analyzes the Real-time relationships to make a closed loop decision on control parameters such as: weight on bit (WOB) and/or rotation per minute (RPM).

The use of surface sensor data avoids communication latencies and bandwidth limitations associated with telemetry from downhole measurements. Such data is termed "fast" data and can normally be obtained with 1 Hz or sub-second sampling frequency, enabling fast drilling energy calculation and determination of optimized values for weight on bit and other operating parameters. The use of fast data also enables timely detection of downhole drilling motor stall while the drill string is rotating, which in turn enables prompt mitigation measures to be implemented. Based on the optimized value determination and/or stall detection, the rotary control module 100 may send control commands to the control system 30 to set target values for one or more of the WOB, RPM, and other operating parameters, thereby enabling closed-loop automation.

The rotary control module 100 may include a "Tag-bottom" logic, typically determined by one or more of the following—an increase in the differential pressure, a change in the surface weight on bit, and the downhole weight on bit (if available from LWD tools) and so forth—which enables determination of the drilling energy versus a selected drilling parameter relationship as the bit tags or first contacts the bottom the wellbore after the driller completes a new connection of drill pipe (i.e., a new stand or length of drill pipe is coupled to the drill string already disposed within the wellbore). As connections are performed regularly, and since the "tag-bottom" process takes very little time (substantially less than a minute), the relationship is re-determined frequently with no slowing of the drilling operation. In this way, the rotary control module 100 enables the optimum values for the operating parameters to be tracked more closely. So long as the driller or automation system 60 maintains the operating parameters near these optimum values, drilling performance is enhanced and BHA life is extended.

The drilling energy analysis preferably employs a synthetic data calculation that may be a function of operating parameter values measured at the surface. Optionally, the calculation of the drilling energy analysis, such as Mechanical Specific Energy (MSE) may use operating data that has been smoothed, such as may be achieved with a smoothing function (e.g., averaging, running average, Bayesian, and other types of smoothing functions as discussed below). The calculated synthetic data (discussed below) and the processed drilling data such as rate of penetration, surface weight on bit, surface torque, flow rate, surface and on-bottom rotary speeds of bottom-hole assembly and mechanical specific energy of the system may optionally be plotted as a function, typically although not necessarily with the calculated synthetic data on the Y-axis as a function of the processed drilling data on the X-axis (not illustrated). The rotary control module 100 then analyzes the distribution or plot derived from the synthetic data to determine optimized values of the operating parameters and to adjust the control targets accordingly.

FIG. 3 shows an illustrative workflow that may be employed by the rotary control module 100 in which at least one of the following steps is employed and, optionally, any combination of the following steps in any order is employed. First, rotary drilling at step 110 is initiated. Raw drilling data is received at the automation system 60 from at least one of the rig sensors 20 directly, from the control system 30, from the EDR 40, or from any secondary interface (such as input by a user with the input device 95) at step 120. The automation system 60 may process and/or filter the received data either automatically, such as by using a smoothing and/or filtering function selected by a user or the user may interactively smooth and/or filter the data using a smoothing interface or window to manually eliminate noise and distortion at step 130. The processed and/or smoothed drilling data is referred to synthetic data at step 135.

The rotary control module 100 may analyze the processed and/or smoothed drilling data over at least one selected time range or a plurality of time ranges at step 140. The time ranges may be referred to as or "learning intervals". The time range or learning interval may be a period determined or set manually by a user and/or the learning interval may be defined by at least one specific condition, such as by comparison with offset well analysis (discussed below with respect to the correlation engine) at step 140. A few, representative but non-limiting examples of the operating conditions that may trigger a learning interval 140 may be at least one of "tagging-bottom" after addition of a new stand of drill pipe; observing a sufficiently smooth variation of an operating parameter over a sufficient range of values and/or time; and a significant change (at least plus-or-minus 5 percent, 2 percent, 1 percent, or smaller) between at least a) one previously observed value and/or b) at least one previously observed or measured trend in at least one of the operating parameters.

Resulting values are collected on the storage medium 90, where the automation system 60 analyzes the distribution or plot of the of at least one calculated synthetic parameter (e.g., MSE) and processed and/or smoothed input data at step 150 (MSE Trend Analysis). A solution may be determined when the at least one calculated synthetic parameter, such as MSE, is at a minimum or a minima for the at least one selected processed and/or smoothed input or processed drilling data at step 155.

If the automation system 60 determines a solution (e.g., a minima for MSE) at step 155, the automation system 60 then optionally may calculate the confidence in that solution at step 160. In other words, the automation system may calculate and present a confidence indicator in the solution as a percentage or a range (e.g., low confidence, medium confidence, high confidence) as indicated at step 160.

Provided the confidence is above a selected threshold value at step 160, the automation system 60 may then make at least one drilling recommendation based on the distribution analysis and several preconditions for at least one controllable drilling parameter (weight on bit, RPM, flow rate of drilling fluid) that correlates with the at least one selected smoothed and/or processed drilling data at step 130. The drilling recommendation optionally may be sent as an executable control command to the rig control system 30 either directly or via the secondary interface (output device 80). In some embodiments, the executable drilling commands are presented to the driller/TSD/operator as a recommendation via a report or any output interface 80 viewable by the user including the EDR system 40. In other embodiments, the automation system 60 optionally may send an executable control command as an actual setting for at least one controllable drilling parameter to the control system 30. Alternatively, the automation system X may optionally send the executable control command as a desired target value for at least one controllable drilling parameter to an Auto-Driller (i.e., an automated program that may be part of the control system 30). Thus, the drilling recommendation to change a selected parameter may thus be either accepted manually by the user or accepted automatically at step 165. Drilling would then continue using the at least one selected parameter as a target or guide as recommended by the automation system 60 at step 170.

Optionally, if the automation system 60 is unable to determine a solution for the at least one synthetic calculation or data (e.g., a minima for MSE) at step 155 or the solution confidence at step 160 fails to meet or exceed a selected (by the user) or automatically determined threshold at step 160, the automation system 60 optionally recommends to the user and/or instructs the control system 30 to continue drilling at the same parameters at step 180 and/or optionally indicates to the user via the output interface 80 and/or instructs the control system 30 to reject the proposed change in the at least one selected parameter at step 130 and to continue drilling with the at least one selected parameter at step 185, respectively. Optionally, the automation system 60 may then either automatically or manually be instructed to initiate a new learning interval at step 140 as described above.

Sliding Control Module

Figure 4:
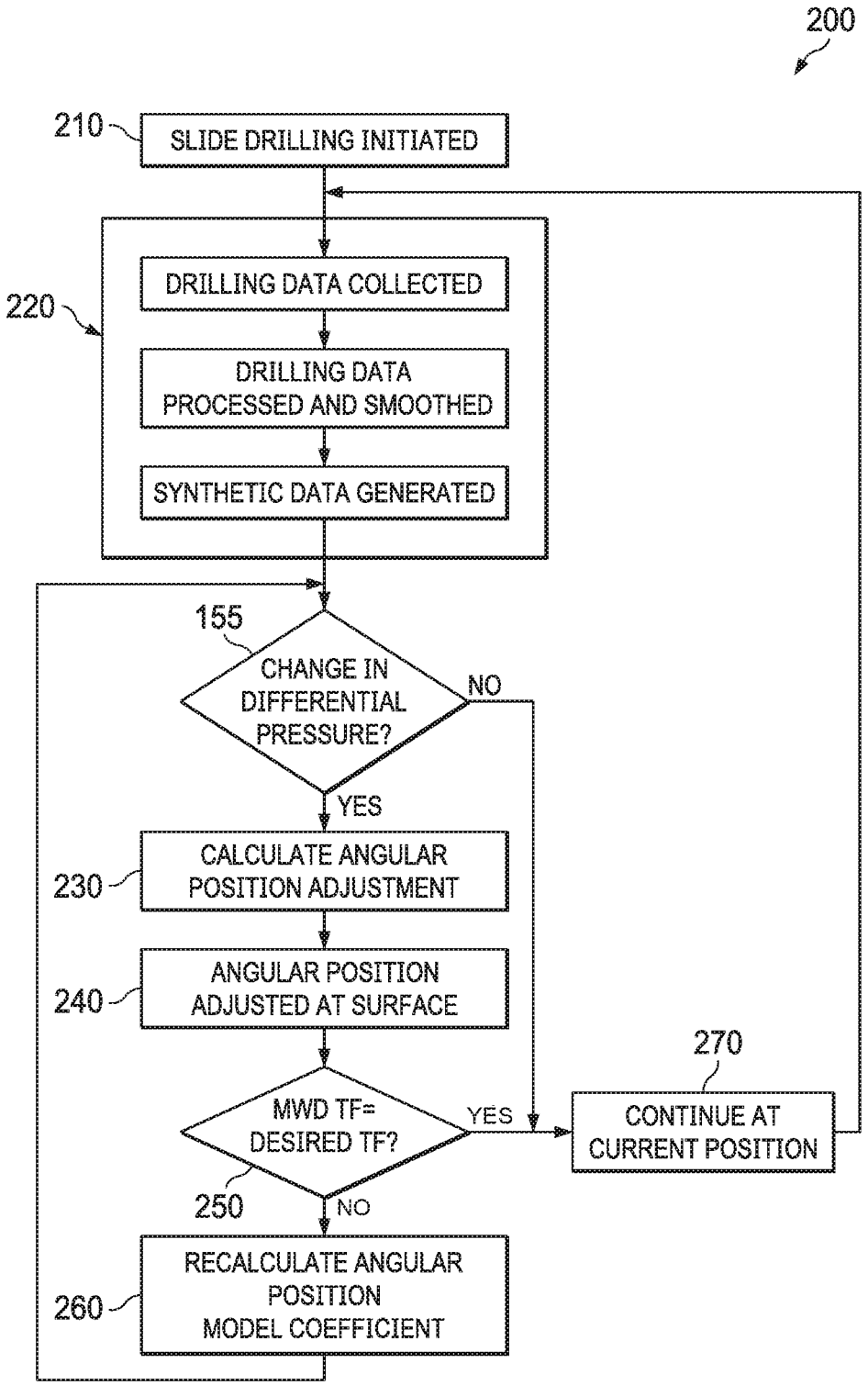
FIG. 4 illustrates a sliding control module of the automation system.

The sliding control module 200 illustrated in FIG. 4 as implemented by the automation system 60 is a method for automated directional drilling of a well bore. The sliding control module 200 collects data from surface sensors either directly via the rig sensors 20 and/or indirectly from at least one of the EDR system 40 and the control system 30, and uses the data to calculate the number of wraps to put into the drill string to hold the steerable motor bend orientation (toolface) in the desired position for steering the wellbore. A single wrap is a single, complete rotation of the drill string at the surface of the drill rig that turns motor bend an unknown rotational amount downhole, typically less than a single rotation. The drill string may be rotated several times or several wraps at the surface to effect a single rotation of the motor bend position in the wellbore. The difference in the number of rotations or wraps of the drill string at the surface of the drilling rig as compared to the typically smaller number of wraps or rotations at the motor bend is a function of the elasticity of the drill pipe, the length of the drill string, drag of the drill string in the wellbore, the tortuosity of the wellbore and more. The DD typically must observe in real time the toolface of the motor bend as indicated by the MWD system and incrementally make inputs/rotations of the drill string at the surface and wait to observe the effect of the incremental rotation. This can be a time-consuming processing, taking upwards of thirty or more minutes of NPT as the DD evaluates the results of this multivariable problem during the test and observe process. Moreover, wrong inputs/rotations of the drill string at the surface may result in steering the wellbore to the position to be outside of the desired wellbore trajectory made to fit and accomplish drilling objectives set by the reservoir team and the geology team.

The sliding control system 200 optionally also collects data from the downhole MWD tool at step 220 and may continuously compare the downhole MWD toolface orientation to the total wrap angle calculated by the sliding control module 200 and makes adjustments to the angular position of the drill string at surface using the rotary drive system.

The sliding control module 200 also monitors the toolface orientation variance from the desired orientation to provide a metric for slide efficiency and calculate effective toolface for the slide interval. The module also includes Wrap logic, which calculates the angular offset position required to hold the toolface, and dynamically adjusts the angular offset or increases differential pressure target based on the actual response and downhole data.

When conditions are such that friction between the wellbore and the drill string prevents the effective transfer of weight from the rig surface to the bit to achieve efficient slide drilling, the sliding control module 200 may initiate an oscillatory rotational motion (clockwise and counterclockwise) to the drill string at the surface to reduce the friction along the lateral axis of the drill string and thereby facilitate weight transfer to the bit. The sliding control module 200 receives at least one of weight on bit data, pressure data (typically differential pressure, as discussed below), and downhole weight on bit as may be provided via downhole sensors and as transmitted to the surface, to automatically identify when the bottom hole assembly may benefit from being oscillated and determines an initial value and dynamic updates for the magnitude or amplitude of angular oscillation (the degree of rotation) and the frequency for which the clockwise/counterclockwise rotation is conducted.

The slide control module 200 includes workflow for "go-to-bottom" operation while adjusting the angular position and setting differential pressure target.

The slide control module 200 further calculates a slide efficiency as a relation of effective slide drilling distance (i.e., the distance drilled during slide drilling that creates a change in the direction and/or inclination of the well bore) to the total slide drilling distance. The relationship may be a this may be a simple ratio or curve fit or a polynomial function that empirically relates the data. The slide control module 200 may further provide motor stall detection while sliding using a change (second or third derivative, e.g., a rate of change) of at least one or more operating parameter measurements to perform early identification and mitigation of drilling motor stall. For example, a rapid increase in the differential pressure and/or torque (downhole torque, if available, or surface torque if rotary drilling) may suggest the drilling motor is near a stall condition or has stalled.

The sliding control module 200 is configured to automatically rotate the drill string that includes a steerable drilling motor at an end thereof so that the bend in the steerable motor is oriented in a predetermined azimuthal direction, enabling the wellbore to be deviated in the direction of the bend of the steerable motor. The angular position of the drill string at surface is automatically rotated to maintain the position or toolface of the bend of the steerable motor to the desired position with respect to a fixed reference. A rate and magnitude of adjustment of the position of the drill string at surface are automatically controlled so that at the position of the bend of the steerable motor is maintained within an incremental position range (e.g., less than or equal to the targeted orientation plus-or-minus 90 degrees (vertically and/or horizontally) of the targeted orientation, less than or equal to the targeted orientation plus-or-minus 45 degrees (vertically and/or horizontally), less than or equal to the targeted orientation plus-or-minus 15 degrees (vertically and/or horizontally), less than or equal to the targeted orientation plus-or-minus 10 degrees (vertically and/or horizontally), less than or equal to the targeted orientation plus-or-minus 5 degrees (vertically and/or horizontally), of the targeted orientation, and smaller ranges as desired) and dependent on wellbore trajectory, the mechanical output of steerable motor and drill string dimensions.

The transition from rotary drilling to sliding mode is made when it is desired to deviate the wellbore in a given direction. The transition may be initiated by the user, by an automation system, or by another auxiliary system. (Similarly, the transition from sliding to rotary drilling modes can be initiated by the user, automation system, or other auxiliary system.) At that time, the automated execution of the slide drilling process with a steerable motor BHA may be initiated with the distance of the slide interval and the direction of the desired toolface angle being provided as inputs. These inputs can be manually entered by the user or provided by a secondary interface based on the trajectory requirements, i.e., a drilling plan and well trajectory/design may be input by a user into the automation system 60 and stored in the memory 90 or as calculated by the well positioning module discussed below.

As the drilling process is initiated, the engagement of the drill bit with the bottom of the bore hole will result in an increase in pressure inside the drill string, from which the automation system 60 and the sliding control module 200 may determine that the drill bit is in contact with the bottom of the well bore, i.e., the drill bit has "tagged bottom." This increase in pressure is referred to as differential pressure and is measured by sensors in the rig pumping system. The differential pressure is linearly proportional to the torque exerted by the downhole drilling motor and can effectively serve as a measure of the load being placed on the motor by the bit/borehole interaction. The exertion of torque from the motor will result in the reactive response of the drill string causing it to rotate in the opposite direction of the torque being applied by the motor. This counterclockwise motion of the toolface angle (i.e., the same direction as the reactive torque), tends to cause a misalignment of the toolface angle from its initial angular position when the motor was exerting no torque on the drill string.

For the steerable motor to efficiently deviate the well in the desired direction, the steerable motor and more specifically the motor bend should maintain the angular position of the motor bend within the well bore within a defined tolerance. To compensate for the reactive torque and to maintain the downhole position of the toolface angle, the angular position of the drill string at surface is adjusted by the rotary drive system. The angular position of the drill string at surface required to maintain the downhole toolface of the motor bend may be calculated at step 230 by a modified form of Hooke's Law that accounts for the complexity of the drill string and influences from friction, borehole geometry, and wellbore trajectory. To confirm and refine the solution of the mathematical model used for calculating the rotary drive adjustments to be made at the surface to the drill string, a self-learning algorithm within the sliding control module 200 may compare and, optionally, continuously compare, at least one angular surface position of the drill string to a corresponding position of the downhole toolface position from MWD toolface data relative to at least a position of the angular surface position and the downhole toolface at least one preceding time or moment. The sliding control module acts to minimize or reduce the difference or variance in the toolface angle from the desired position. The aforementioned variance between the measured MWD toolface angle and the desired toolface angle is analyzed and recorded for the duration of slide drilling interval and is quantified to produce an efficiency metric as an angle of vector sum of each sliding interval. In other words, a directional vector for each sliding interval may be calculated from the data, and the sum of those directional vectors may be made so that the sum can be compared to a target vector desired to be met so that the well bore will be steered and positioned as accurately as possible as compared to the well plan. for the executed slide interval.

At times, the static friction force between the drill string and the borehole may be sufficiently high so as to prevent effective weight transfer from the surface to the bit along the central axis of the drill string. This condition is often the result of excessive side forces acting on the drill string, lack of fluid lubricity, or any number or combination of contributing factors. When this condition is present, it can often be addressed through the introduction of a dynamic rotational motion that supplies motion to the drill string, thereby converting static friction into a reduced dynamic friction force that enables both torsional energy and weight to be effectively transferred through the drill string to the BHA or bit. The dynamic rotational motion can be provided as a driven oscillatory rotational motion with an amplitude sufficient to overcome frictional forces between the drill string and borehole and enable the controlled application of weight and torque to the BHA and bit. The oscillatory rotational motion is the same as that described above.

The sliding control module 200 employs a self-learning system that continuously samples and monitors the relationship of at least one of the weight on bit at surface (SWOB) as compared to at least one of the downhole weight on bit (DWOB) either measured directly via downhole sensors, the downhole weight on bit as calculated via the differential pressure, and the differential pressure. If this relationship is monotonic, the system will add surface weight on bit (SWOB) until the at least of the limiting parameters, such as surface or downhole WOB limits, ROP limit, torque limit, differential pressure or standpipe pressure limits, and so forth, are reached. Limiting parameters can be defined manually by the user, by an Auto-Driller system, or by an auxiliary automation system. If the relationship does not follow a monotonic relationship, the automation system 60 and the sliding control module 200 can initiate a rotational oscillatory motion at the surface of the drill string that will incrementally increase the amplitude (i.e., the rotational arc over which the control system 30 rotates the drill string at the surface) and/or frequency (i.e., the frequency at which the control system 30 rotates the drill string first in a clockwise direction and then in a counter-clockwise direction) to reduce the axial friction applied to the drill string and to restore the monotonic relationship between the SWOB and at least one of the DWOB (whether directly measured or calculated from differential pressure) and/or the differential pressure. The amplitude of such oscillation may be calculated by the automation system 60 automatically and optionally may be adjusted based on self-learning algorithms comparing the surface and downhole data. The automation system 60 and the sliding control module 200 will instruct the user and/or the control system 30 to continue oscillating the drill string at the surface until either the limiting parameters are reached or monotonicity ceases. If the latter, the oscillation will incrementally increase the amplitude and/or frequency (as discussed above) until monotonicity of the SWOB relative to at least one of the DWOB (whether directly measured or calculated from differential pressure) and/or the differential pressure is restored and limiting parameters are reached and repeating as necessary.

The trajectory deviation vector can be supplied as input by the user, by the well positioning module (discussed further below), or by another auxiliary system. It may be adjusted by the sliding control module based on the slide efficiency metric. The initiation or termination of oscillatory motion may be triggered by the user, the automation system or another auxiliary system.

As illustrated in FIG. 4, the sliding control module 200 optionally includes initiating slide drilling at step 210; receiving drilling data at step 220 (analogous to the collecting data at step 120 in FIG. 3), calculating the difference between the angular position of the drill string at the surface and the toolface at the bit and determine the number of wraps or rotations that may needed to adjust the toolface to the desired toolface at step 230; adjusting the angular position of the drill string at the surface at step 240; and measuring the toolface and comparing the measured toolface at the motor bend to the desired toolface at step 250.

If the measured toolface is not equal to the desired toolface, the number of wraps or rotations of the drill string at the surface might be needed to set the toolface at the bit are recalculated at step 260; and the difference between the toolface and the angular position of the drill string at the surface is recalculated at step 230 and the process repeats.

If, however, the measured toolface is equal to the desired toolface (within the selected range) at step 260 the sliding control module 200 may provide an indicate on the output interface 80 or output device for the DD or the driller to maintain slide drilling with the current toolface and/or instruct the control system 30 to maintain the selected tool face at step 270. During drilling, if a change in differential pressure or DWOB is detected at step 280, the sliding control module 200 may optionally then calculate the angular position of the drill string at the surface and the toolface at step 230 and repeat the process.

Correlation Engine

The correlation engine 300 as illustrated in FIG. 1 may be a module stored within the memory 90 of the automation systems 60 and/or, as illustrated, a cloud based module that may enable the user to improve the efficiency of the previous systems by integrating offset well data into the various modules as described above, thereby providing pre-optimized ranges of target inputs, such as surface or downhole WOB minimums and maximums along the wellbore; differential and/or standpipe pressure limits; motor stall pressure data, downhole tool, drill string, and bit torque limits; dogleg limits, and so forth based on learnings from historical data. The correlation engine may process the drilling parameter logs from offset wells selected by the user. The logs may be interpolated and/or combined with interpreted horizons from seismic surveys to predict where future wells will encounter various formations. The correlation engine may further supply the rotary control module 100 and sliding control module 200 with various parameters derived from the offset logs to proactively generate and predict optimum values for operating parameters within each formation. In other words, the rotary control module 100 and the sliding control module 200 as described above may optionally be used with real-time data and they may be used with historical data in order to provide preliminary estimates of optimized parameters for the DD and the driller and/or the control system 30 to use as a starting part when drilling and sliding, thereby further reducing the time to optimize the parameters. Stated differently, the figures for the rotary control module 100 and the sliding control module 200 are identical when used in a predictive capacity with offset well data, the only difference, as one of skill in the art would appreciate, is the source of the data. Based on the extracted values and formation positions, the correlation engine 300 may generate the roadmap instructions (i.e., min and max values for the operating parameters) for the rotary control module 100 and the sliding control module 200 to operate within. The user will also be able to manually adjust the operating parameters, approve the operating parameters, and send the operating parameters to the control system 30 or automation system 30.

Well Position Module

A well position module 400 implements an automated guidance method for well positioning and may be part of the program stored within the memory 90 of the automation system and/or stored in the cloud 45. The well position module accepts as an input a predetermined trajectory and attempts to steer the new borehole along a matching trajectory using the location and orientation information provided by the chosen wellbore location methodology. Subject to limitations on tortuosity, the well position module transitions between the sliding mode and rotary drilling mode, invoking the appropriate sliding control module 200 or the rotary control module 100 as needed to correct for deviations from the desired trajectory. The well position module 400 may run as an independent application on the rig control system 30 or as a part of the automation system 60. It may be implemented and accessed by user as part of the automation system 60, which is connected to the rig control system 30 and an online server. The well position module 400 may make decisions on the drilling execution sequence and sends commands with relevant inputs to at least one of the rotary control module 100 and the sliding control module 200. It may alternatively be implemented and accessed by a user as part of cloud-based system 45. In either case, a user may access the well position module 400 to enter and change well profile information in real-time, including anti-collision analysis and offset analysis The rotary control module 100, sliding control module 200, correlation engine 300, and the well position module 400 can operate and be employed individually or collectively in any combination as a combined automation system 60 Each module within the combined automation system 60 can send commands, processed data, and inputs to other modules within the combined automation system 60 and to the control system 30 directly via different interfaces.

Though the operations shown and described above are treated as being sequential for explanatory purposes, in practice the methods may be carried out by multiple components or systems operating concurrently and perhaps even speculatively to enable out-of-order operations. The sequential discussion is not meant to be limiting. These and numerous other modifications, equivalents, and alternatives, will become apparent to those skilled in the art once the above disclosure is fully appreciated. It is intended that the following claims be interpreted to embrace all such modifications, equivalents, and alternatives where applicable.

An illustrative method embodiment for drilling a wellbore comprises: receiving a drilling parameter input data; processing the input drilling parameter data; calculating new synthetic parameter functions from processed input data in time ranges defined by specific conditions and collecting the function values; analyzing relationships of calculated synthetic parameters and processed input data; making drilling recommendations based on analysis results and several preconditions for at least 1 controllable drilling parameter.

An illustrative non-transient information storage medium embodiment comprises computer-executable process steps that provide an application programming interface (API) with an instruction set which is adapted to receive a set of drilling parameter data; process the drilling parameter data; calculate new synthetic parameter functions from processed input data in time ranges defined by specific conditions and collecting the function values; analyze distributions of calculated synthetic parameters and processed input data; find minimums for objective function curves for a given interval of drilling; and make drilling recommendations based on distribution analysis and several preconditions for at least 1 controllable drilling parameter.

An illustrative method embodiment for directional drilling control automation comprises, in a drilling apparatus comprising a bit with a steerable motor having a toolface and a rotary drive adapted to steer the bit during the drilling operation: taking a slide distance, desired toolface for sliding from the end user, as well as other drilling apparatus data and start depth; preparing for sliding by stopping rotation of the drill string in the first direction and automatically orienting the toolface of a steerable drilling motor in a desired toolface direction by adjusting the angular position of the drill string and removing residual torque from the drill string and confirming the position of the bit downhole in the desired direction; re-engaging the drill bit on the bottom of the borehole and initiating the slide drilling sequence; adjusting the angular position of the drill string to a dynamically calculated position and/or increasing differential pressure target to maintain the orientation of the toolface as the drilling motor exerts torque on the drill string; sampling and recording the toolface orientation during the drilling sequence and evaluating the actual toolface distribution against the desired toolface range to provide a metric for efficiency for the slide drilling sequence and dynamically adjust the positioning logic; implementing an oscillatory rotational motion to the drill string to achieve and maintain a monotonic relationship between surface weight on bit (SWOB) and downhole weight on bit (DWOB); terminating the slide drilling sequence; and initiating a rotary drilling sequence.

An illustrative non-transient information storage medium embodiment comprises computer-executable process steps that provide an application programming interface (API) with an instruction set which is adapted to: receive and record drilling parameter and sensor data at a certain frequency; and conduct data processing and mathematical modeling of drilling parameter and sensor data.

An illustrative system embodiment for drilling optimization and directional drilling automation comprises: a network interface to send and receive drilling related data; a processor coupled to the network interface and programmable to process and analyze the drilling data according to the rotary drilling, sliding drilling, correlation, and guidance methods disclosed herein; a storage medium in communication with the processor to store the plurality of processed drilling parameter data, calculated synthetic parameter function values, and the plurality of instructions including at least 1 controllable drilling parameter; and a means to send at least 1 drilling execution command to rig control system either directly or through a secondary interface.

Any of the foregoing embodiments and any of the numbered embodiments below may be implemented individually or conjointly, and each of the foregoing embodiments and each of the numbered embodiments below, individually or in combination, may further employ any one or more of the following optional features in any combination as desired: 1. the drilling parameter data is real-time. 2. the drilling parameter data is memory based. 3. the data processing applied is based on different smoothing window algorithms including but not limited to Linear, Hanning, Hamming, Blackman-Harris, Blackman, Flat top. 4. the smoothing window algorithm is applied across all raw and processed drilling parameter data. 5. the synthetic function is comprised of Penetration (ROP), surface weight on bit, surface torque, rotary speed. 6. the specific conditions of the time range are end user defined. 7. the specific conditions of time range are defined by offset correlation analysis. 8. the specific conditions of time range are defined by the auxiliary automation system. 9. the recommended set of parameters are automatically applied to the drilling environment. 10. the generated recommendations are shown on the main application window for consideration by a user. 11. the generated recommendations and all intermediate calculations are exported to a report file. 12. the process tracks the success of execution of recommendations. 13. the generated operational recommendations are exported to a control system adapted to implement the operational recommendations during the drilling operation. 14. the trajectory vector is defined and input by the user. 15. the trajectory vector is defined and input by an auxiliary automation system. 16. the adjusted angular position of the drill string is determined by a function referencing a previous angular position of the drill string. 17. the change in angular position of the drill string is determined by a mathematical model. 18. the automatic angular position adjustments of the drill string are validated by continuous feedback from downhole and surface sensor data. 19. the automatic angular position adjustments of the drill string are processed by a self-learning algorithm to reduce variation in toolface position. 20. the slide drilling sequence is initiated by the user or the auto drilling system on equipped drilling rigs. 21. the slide drilling sequence is initiated by an auxiliary automation system. 22. the slide drilling sequence is terminated by the user or the auto drilling system on equipped drilling rigs. 23. the slide drilling sequence is terminated by an auxiliary automation system. 24. the rotary drilling sequence is initiated by the user. 25. the rotary drilling sequence is initiated by an auxiliary automation system. 26. the oscillatory angular motion is initiated by an auxiliary automation system. 27. the rotary drilling sequence is initiated by the auto drilling system on equipped drilling rigs. 28. the processed data is used to calculate changes in angular position of the drill string. 29. the processed data is used to determine the relationship between surface weight on bit (SWOB) and downhole weight on bit (DWOB) and/or differential pressure. 30. the processed data is used to calculate the efficiency of a given slide sequence and the result is displayed and recorded. 31. the processed data is used to generate a self-learning protocol to validate calculated changes in the angular position of the drill string in reference to the toolface position of the drilling motor. 32. the processed data is used to generate, analyze and refine a sinusoidal oscillating function to achieve and maintain a monotonic relationship between surface weight on bit (SWOB) and downhole weight on bit (DWOB) and/or differential pressure. 33. the processed data is used to determine if angular oscillatory motion is required and recommendation for initiation is displayed to and optionally executed by the user. 34. the processed data is used to determine if the angular oscillatory motion is required and said motion is automatically initiated by the auxiliary automation system. 35. the drilling execution command is presented to end user as a recommendation.

The one or more present inventions, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

NUMBERED EMBODIMENTS

The following numbered embodiments may depend from and/or be combined—either in whole or in any sub-part or any clause—in any manner with any of the other numbered embodiments and/or any of the elements recited above even if not expressly repeated below. The individual numbered embodiments below are not mutually exclusive with any other numbered embodiment(s) and/or the any of the features recited above.

Embodiment 1

A rotary drilling performance enhancement method that comprises: collecting surface operating parameter measurements as a function of time; filtering and/or smoothing the collected measurements to obtain filtered and/or smoothed values of at least one operating parameter; synthesizing a measure of drilling energy from the filtered and/or smoothed values; identifying learning intervals based at least in part on the filtered and/or smoothed values, each of the learning intervals including a transition of a drill string from off-bottom to on-bottom and/or significant change of at least one operating parameter; building, in each learning interval, a distribution of the drilling energy to at least one operating; analyzing the distribution of the drilling energy to at least one operating parameter to find the operating parameter value corresponding to the minimum of the drilling energy in pre-defined operating parameter range; and adjusting a target value for the at determined operating parameter value.

Embodiment 2

A sliding drilling performance enhancement method that comprises: collecting operating parameter measurements as a function of time; filtering and/or smoothing the collected measurements and or accumulating such measurements by other parameter time or depth step to obtain filtered and/or smoothed and/or accumulated measurements; rotating a drill string and/or changing differential pressure target and/or bit weight target to set a bottomhole assembly (BHA) toolface at a target orientation; deriving a relationship between the at least one operating parameter and the BHA toolface; adapting a total wrap angle and/or differential pressure and/or bit weight target based on the derived relationship to dynamically maintain the BHA toolface at the target orientation

Embodiment 3

A sliding drilling oscillation method that comprises: collecting operating parameter measurements as a function of time; filtering and/or smoothing the collected measurements and or accumulating such measurements by other parameter time or depth step to obtain filtered and/or smoothed and/or accumulated measurements; determining whether a relationship between a surface weight on bit (SWOB) change and differential pressure change is monotonic; applying rotary oscillation to the drill string if the relationship is not monotonic; and adapting an amplitude of rotary oscillation to dynamically maintain monotonic relationship between SWOB and differential pressure

Embodiment 4

A drilling roadmap planning method that comprises: obtaining operating parameter measurements from existing wells; filtering the collected measurements to obtain filtered values of at least one operating parameter; synthesizing a measure of drilling energy from the filtered values; identifying learning intervals based at least in part on the filtered values, each of the learning intervals including a transition of a drill string from off-bottom to on-bottom and/or significant change of at least one operating parameter; deriving, in each learning interval, a relationship between the at least one operating parameter and the drilling energy; associating the relationships with earth formations penetrated by the existing wells; and using the relationships for each formation to set minimum and maximum values of the at least one operating parameter for that formation; obtaining the desired trajectory and well location for a new borehole; processing operating parameter measurements from offset wells to determine a roadmap for operating parameter values along the desired trajectory.

Embodiment 5

An automated guidance method that comprises: obtaining a desired trajectory for a borehole; processing operating parameter measurements from offset wells to determine a roadmap for operating parameter values including drilling tendency and dogleg severity along the desired trajectory and/or manually enter operating parameter values along the desired trajectory; employing a rotary control module during rotary drilling sequence to optimize operating parameter values within limits set by the roadmap and/or entered manually by an operator; employing a sliding control module during sliding drilling sequence to optimize operating parameter values within limits set by the roadmap and/or entered manually by an operator; monitoring a bottom hole assembly (BHA) position relative to the desired trajectory based on real-time data streamed directly from MWD system or entered manually by an operator; and alternating between rotary drilling and sliding drilling based on the measured position of the wellbore relative to desired position to steer the BHA along the desired trajectory by providing recommendation at the rig site or employing sliding and rotary control modules directly via Rig Control System.

Embodiment 6

An automation system for a drilling rig, the automation system comprising: a processor configured to implement computer executable instructions, the processor being: couplable to at least one of a) a rig control system, b) an electronic data recorder, and c) at least one rig sensor; configured to receive at least one of a) at least one surface operating parameter generated by the at least one rig sensor and b) at least one downhole operating parameter generated by at least one tool disposed in a wellbore; at least one input device in communication with the processor and configured to receive a user input; at least one output device in communication with the processor; a computer memory in communication with the processor and storing computer executable instructions, that when implemented by the processor cause the processor to perform functions comprising: receiving as a function of time at least one of a) the at least one surface operating parameter b) the at least one downhole operating parameter; at least one of filtering and smoothing the at least one of a) the at least one surface operating parameter and b) the at least one downhole operating parameter to generate processed data; and, generating a measure of drilling energy from the processed data; identifying at least one learning interval; calculating a distribution of the measure of drilling energy as a function of the processed data; determining a minimum of the measure of the drilling energy; and, calculating a target value of the at least one of a) the at least one surface operating parameter and b) the at least one downhole operating parameter.

Embodiment 7

The automation system of Embodiment 6, wherein the functions further comprise displaying the target value on the output device.

Embodiment 8

The automation system of Embodiment 6 or Embodiment 7, wherein the functions further comprise transmitting the target value to a control system communicatively coupled to the automation system.

Embodiment 9

The automation system of any of Embodiments 6 through 8, wherein the functions further comprise transmitting at least one of the target value, the measure of drilling energy, the at least one surface operating parameter, and the at least one downhole operating parameter to another Internet connected device.

Embodiment 10

The automation system of any of Embodiments 6 through 9, wherein the at least one tool disposed within the wellbore is one of a measurement while drilling tool and a logging while drilling tool.

Embodiment 11

The automation system of any of Embodiments 6 through 10, wherein the at least one learning interval is a function of at least one of a) the processed data, b) a transition of a drill string disposed within the well bore from off a bottom of the well bore to on the bottom of the well bore, and c) a change of at least one of the at least one surface operating parameter and the at least one downhole operating parameter greater than or equal to 1 percent of the at least one surface operating parameter and the at least one downhole operating parameter at a preceding time.

Embodiment 12

The automation system of any of Embodiments 6 through 11, wherein the calculating the distribution of the measure of drilling energy as a function of the processed data further comprises plotting the measure of drilling energy against the processed data.

Embodiment 13

The automation system of any of Embodiments 6 through 12, wherein the functions further comprise: calculating a first toolface of a drill bit; comparing the first toolface to a target toolface; calculating a second toolface of the drill bit after at least one of a) rotating a drill string disposed in the well bore b) changing a differential pressure and c) changing at least one of a surface weight on bit and a downhole weight on bit; and, deriving a relationship between the processed data and the second toolface.

Embodiment 14

The automation system of Embodiment 13, wherein the functions further comprising: calculating a toolface adjustment factor as a function of the relationship between the processed data and the second toolface, wherein the toolface adjustment factor is a recommended adjustment to be applied to the drill string so as to maintain a third toolface of the drill bit at the targeted toolface; applying the toolface adjustment factor to the drill string; calculating the third toolface after the toolface adjustment factor has been applied to the drill string; comparing the third toolface to the targeted toolface; and one of a) recalculating the toolface adjustment factor if the third toolface is not substantially equal to the targeted toolface and b) holding the third toolface and slide drilling if the third toolface is substantially equal to the targeted toolface.

Embodiment 15

The automation system of Embodiment 14, wherein the toolface adjustment factor comprises at least one of a number of drill string rotations to be applied to the drill string, a targeted differential pressure, a targeted surface weight on bit, and a targeted downhole weight on bit.

Embodiment 16

The automation system of any of Embodiments 13 through 15, wherein the functions further comprise: changing the surface weight on bit and the differential pressure; determining whether a relationship between the change in the surface weight on bit and the change between the differential pressure change is monotonic; and if the relationship between the change in the surface weight on bit and the change between the differential pressure change is monotonic is not monotonic applying a rotary oscillation to the drill string.

Embodiment 17

The automation system of Embodiment 16, wherein the functions further comprise comprises adjusting at least one of a frequency and an amplitude of the rotary oscillation until the relationship between the change in the surface weight on bit and the change between the differential pressure change until the relationship becomes monotonic.

Embodiment 18

A method of developing a drilling plan for a well bore, comprising: obtaining at least one operating parameter as function of at least one of time and of depth from an existing offset well; using the processor of the automation system of any of Embodiments 6 through 17 to execute the functions of claim 1 with the at least one operating parameter as a substitute for at least one of a) the at least one surface operating parameter and b) the at least one downhole operating parameter.

Embodiment 19

The method of Embodiment 18, further comprising calculating at least one of a minimum target value and a maximum target value for of the at least one the at least one operating parameter from the existing offset well for a given formation.

Embodiment 20

The method of Embodiment 18 or 19, further comprising generating a recommended trajectory for a new well bore.

Embodiment 21

A drilling rig that includes the automation system of any of Embodiments 6 through 17 coupled to at least one of a) the rig control system, b) the electronic data recorder, and c) the at least one rig sensor.

Embodiment 22

A method of drilling well, comprising: assembling a drill string and a bottom hole assembly; disposing the drill string and the bottom hole assembly in a well bore; and, calculating with the automation system of any of Embodiments 6 through 17, the target value of the at least one of a) the at least one surface operating parameter and b) the at least one downhole operating parameter.

Embodiment 23

The automation system of any of Embodiments 6 through 17, wherein determining the minimum of the measure of drilling energy further comprises calculating the measure of drilling energy at a founder point.

Embodiment 24

A method of optimizing at least one of a) at least one surface operating parameter and b) at least one downhole operating parameter used during drilling a well bore, the method comprising: receiving as a function of time at least one of a) the at least one surface operating parameter b) the at least one downhole operating parameter; at least one of filtering and smoothing the at least one of a) the at least one surface operating parameter and b) the at least one downhole operating parameter to generate processed data; and, generating a measure of drilling energy from the processed data; identifying at least one learning interval; calculating a distribution of the measure of drilling energy as a function of the processed data; determining a minimum of the measure of the drilling energy; and, calculating a target value of the at least one of a) the at least one surface operating parameter and b) the at least one downhole operating parameter.

Embodiment 25

A method of optimizing slide drilling comprising: receiving as a function of time at least one of a) the at least one surface operating parameter b) the at least one downhole operating parameter; at least one of filtering and smoothing the at least one of a) the at least one surface operating parameter and b) the at least one downhole operating parameter to generate processed data; and, generating a measure of drilling energy from the processed data; identifying at least one learning interval; calculating a first toolface of a drill bit; comparing the first toolface to a target toolface; calculating a second toolface of the drill bit after at least one of a) rotating a drill string disposed in the well bore b) changing a differential pressure and c) changing at least one of a surface weight on bit and a downhole weight on bit; and, deriving a relationship between the processed data and the second toolface.

Embodiment 26

The method of Embodiment 25, wherein the functions further comprising: calculating a toolface adjustment factor as a function of the relationship between the processed data and the second toolface, wherein the toolface adjustment factor is a recommended adjustment to be applied to the drill string so as to maintain a third toolface of the drill bit at the targeted toolface; applying the toolface adjustment factor to the drill string; calculating the third toolface after the toolface adjustment factor has been applied to the drill string; comparing the third toolface to the targeted toolface; and one of a) recalculating the toolface adjustment factor if the third toolface is not substantially equal to the targeted toolface and b) holding the third toolface and slide drilling if the third toolface is substantially equal to the targeted toolface.

Embodiment 27

The method of Embodiment 26, wherein the toolface adjustment factor comprises at least one of a number of drill string rotations to be applied to the drill string, a targeted differential pressure, a targeted surface weight on bit, and a targeted downhole weight on bit.

Embodiment 28

The method of any of Embodiments 25 through 27, wherein the functions further comprise: changing the surface weight on bit and the differential pressure; determining whether a relationship between the change in the surface weight on bit and the change between the differential pressure change is monotonic; and if the relationship between the change in the surface weight on bit and the change between the differential pressure change is monotonic is not monotonic applying a rotary oscillation to the drill string.

Embodiment 29

The method of Embodiment 28, wherein the functions further comprise comprises adjusting at least one of a frequency and an amplitude of the rotary oscillation until the relationship between the change in the surface weight on bit and the change between the differential pressure change until the relationship becomes monotonic.

Embodiment 30

A method of preparing a drilling plan comprising: obtaining at least one operating parameter as function of at least one of time and of depth from an existing offset well; at least one of filtering and smoothing the at least one operating parameter to generate processed data; and, generating a measure of drilling energy from the processed data; identifying at least one learning interval; calculating a distribution of the measure of drilling energy as a function of the processed data; determining a minimum of the measure of the drilling energy; and, calculating a target value of the at least operating parameter for a new well bore.

Embodiment 31

The method of Embodiment 30, further comprising calculating at least one of a minimum target value and a maximum target value for of the at least one the at least one operating parameter from the existing offset well for a given formation.

Embodiment 32

The method of Embodiment 30 or Embodiment 31, further comprising generating a recommended trajectory for the new well bore.

Embodiment 33

An automation system for a drilling rig, the automation system comprising: a processor configured to implement computer executable instructions, the processor being: couplable to at least one of a) a rig control system, b) an electronic data recorder, and c) at least one rig sensor; configured to receive at least one of a) at least one surface operating parameter generated by the at least one rig sensor and b) at least one downhole operating parameter generated by at least one tool disposed in a wellbore; at least one input device in communication with the processor and configured to receive a user input; at least one output device in communication with the processor; a computer memory in communication with the processor and storing computer executable instructions, that when implemented by the processor cause the processor to perform functions comprising: calculating a first toolface of a drill bit; comparing the first toolface to a target toolface; calculating a second toolface of the drill bit after at least one of a) rotating a drill string disposed in the well bore b) changing a differential pressure and c) changing at least one of a surface weight on bit and a downhole weight on bit; and, deriving a relationship between the processed data and the second toolface.

Embodiment 34

The automation system of Embodiment 33, wherein the functions further comprising: calculating a toolface adjustment factor as a function of the relationship between the processed data and the second toolface, wherein the toolface adjustment factor is a recommended adjustment to be applied to the drill string so as to maintain a third toolface of the drill bit at the targeted toolface; applying the toolface adjustment factor to the drill string; calculating the third toolface after the toolface adjustment factor has been applied to the drill string; comparing the third toolface to the targeted toolface; and one of a) recalculating the toolface adjustment factor if the third toolface is not substantially equal to the targeted toolface and b) holding the third toolface and slide drilling if the third toolface is substantially equal to the targeted toolface.

Embodiment 35

The automation system of Embodiment 33 or Embodiment 34, wherein the toolface adjustment factor comprises at least one of a number of drill string rotations to be applied to the drill string, a targeted differential pressure, a targeted surface weight on bit, and a targeted downhole weight on bit.

Embodiment 36

The automation system of any of Embodiments 33 through 35, wherein the functions further comprise: changing the surface weight on bit and the differential pressure; determining whether a relationship between the change in the surface weight on bit and the change between the differential pressure change is monotonic; and if the relationship between the change in the surface weight on bit and the change between the differential pressure change is monotonic is not monotonic applying a rotary oscillation to the drill string.

Embodiment 37

The automation system of Embodiment 36, wherein the functions further comprise adjusting at least one of a frequency and an amplitude of the rotary oscillation until the relationship between the change in the surface weight on bit and the change between the differential pressure change until the relationship becomes monotonic.

Embodiment 38

An automation system for developing a drilling plan, the automation system comprising: a processor configured to implement computer executable instructions, the processor being: couplable to at least one of a) a rig control system, b) an electronic data recorder, and c) at least one rig sensor; configured to receive at least one of a) at least one surface operating parameter generated by the at least one rig sensor and b) at least one downhole operating parameter generated by at least one tool disposed in a wellbore; at least one input device in communication with the processor and configured to receive a user input; at least one output device in communication with the processor; a computer memory in communication with the processor and storing computer executable instructions, that when implemented by the processor cause the processor to perform functions comprising: obtaining at least one operating parameter as function of at least one of time and of depth from an existing offset well; at least one of filtering and smoothing the at least one operating parameter to generate processed data; and, generating a measure of drilling energy from the processed data; identifying at least one learning interval; calculating a distribution of the measure of drilling energy as a function of the processed data; determining a minimum of the measure of the drilling energy; and, calculating a target value of the at least operating parameter for a new well bore.

Embodiment 39

The automation system of Embodiment 38, wherein the functions further comprise calculating at least one of a minimum target value and a maximum target value for of the at least one the at least one operating parameter from the existing offset well for a given formation.

Embodiment 40

The automation system of Embodiment 38 or Embodiment 39, wherein the functions further comprise generating a recommended trajectory for the new well bore.

Embodiment 41

A drilling rig that includes the automation system of any of Embodiments 33 through 38 coupled to at least one of a) the rig control system, b) the electronic data recorder, and c) the at least one rig sensor.

Embodiment 42

A method of drilling well, comprising: assembling a drill string and a bottom hole assembly; disposing the drill string and the bottom hole assembly in a well bore; and, calculating with the automation system of any of Embodiments 33 through 38, the target value of the at least one of a) the at least one surface operating parameter and b) the at least one downhole operating parameter.

The invention claimed is:

1. An automation system for a drilling rig, the automation system comprising:

a processor configured to receive at least one operating parameter, the at least one operating parameter including at least one of a) at least one surface operating parameter generated by at least one rig sensor from a current well or an existing offset well and b) at least one downhole operating parameter generated by at least one tool disposed in a wellbore of the current well or the existing offset well;

at least one input device in communication with the processor and configured to receive a user input;

at least one output device in communication with the processor; and a computer memory in communication with the processor and storing computer executable instructions that when implemented by the processor cause the processor to perform functions comprising:

receiving as a function of time or depth the at least one operating parameter;

at least one of filtering and smoothing the at least one operating parameter to generate processed data;

generating a measure of drilling energy from the processed data;

identifying at least one portion of the processed data as a learning interval;

calculating from each learning interval a distribution of the measure of drilling energy as a function of the processed data;

determining from each said distribution a minimum of the measure of the drilling energy;

deriving from at least one of the minimums a target value for the at least one operating parameter;

calculating a first toolface of a drill bit;

comparing the first toolface to a target toolface;

calculating a second toolface of the drill bit after at least one of a) rotating a drill string disposed in the well bore, b) changing a differential pressure, and c) changing at least one of a surface weight on bit and a downhole weight on bit; and deriving a relationship between the processed data and the second toolface.

2. The automation system of claim 1, wherein the functions further comprise displaying the target value on the output device.

3. The automation system of claim 1, wherein the functions further comprise transmitting the target value to a control system communicatively coupled to the automation system.

4. The automation system of claim 1, wherein the functions further comprise transmitting at least one of the target value, the measure of drilling energy, the at least one surface operating parameter, and the at least one downhole operating parameter to another Internet connected device.

5. The automation system of claim 1, wherein the at least one tool disposed within the wellbore is one of a measurement while drilling tool and a logging while drilling tool.

6. The automation system of claim 1, wherein the at least one learning interval is a function of at least one of a) the processed data, b) a transition of a drill string disposed within the well bore from off a bottom of the well bore to on the bottom of the well bore, and c) a change of at least one of the at least one operating parameter greater than or equal to 1 percent of the at least one operating parameter at a preceding time.

7. The automation system of claim 1, wherein the calculating the distribution of the measure of drilling energy as a function of the processed data further comprises plotting the measure of drilling energy against the processed data.

8. The automation system of claim 1, wherein the functions further comprise:

calculating a toolface adjustment factor as a function of the relationship between the processed data and the second toolface, wherein the toolface adjustment factor is a recommended adjustment to be applied to the drill string so as to maintain a third toolface of the drill bit at the targeted toolface;

applying the toolface adjustment factor to the drill string;

calculating the third toolface after the toolface adjustment factor has been applied to the drill string;

comparing the third toolface to the targeted toolface; and one of a) recalculating the toolface adjustment factor if the third toolface is not substantially equal to the targeted toolface and b) holding the third toolface and slide drilling if the third toolface is substantially equal to the targeted toolface.

9. The automation system of claim 8, wherein the toolface adjustment factor comprises at least one of a number of drill string rotations to be applied to the drill string, a targeted differential pressure, a targeted surface weight on bit, and a targeted downhole weight on bit.

10. The automation system of claim 1, wherein the functions further comprise:

changing the surface weight on bit and the differential pressure;

determining whether a relationship between the change in the surface weight on bit and the differential pressure change is monotonic; and if the relationship between the change in the surface weight on bit and differential pressure change is not monotonic applying a rotary oscillation to the drill string.

11. The automation system of claim 10, wherein the functions further comprise adjusting at least one of a frequency and an amplitude of the rotary oscillation until the relationship between the change in the surface weight on bit and the differential pressure change becomes monotonic.

12. The automation system of claim 1, wherein the at least one operating parameter is from the existing offset well, and wherein the functions further comprise calculating at least one of a minimum target value and a maximum target value for the at least one operating parameter for a given formation.

13. The automation system of claim 12, wherein the functions further comprise generating a recommended trajectory for a new well bore.

14. A drilling rig that includes the automation system of claim 1 coupled to at least one of a) a rig control system, b) an electronic data recorder, and c) the at least one rig sensor.

15. A method of drilling well, comprising:

assembling a drill string and a bottom hole assembly;

disposing the drill string and the bottom hole assembly in a well bore; and, calculating with the automation system of claim 1, the target value of the at least one operating parameter.

* * * * *